US009302883B2

(12) United States Patent
Brendle et al.

(10) Patent No.: US 9,302,883 B2
(45) Date of Patent: Apr. 5, 2016

(54) CORE FOR A PRODUCT IN SHEET FORM WOUND AROUND THIS CORE, AND ROLL FORMED WITH SUCH A CORE

(75) Inventors: Damien Brendle, Obersaasheim (FR); Benoit Hoeft, Bischwihr (FR); Pierre Laurent, Turckheim (FR); Rene Sigwalt, Kunheim (FR); Remy Ruppel, Durrenentzen (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 637 days.

(21) Appl. No.: 13/264,295

(22) PCT Filed: Feb. 1, 2011

(86) PCT No.: PCT/IB2011/000164

§ 371 (c)(1),
(2), (4) Date: Oct. 13, 2011

(87) PCT Pub. No.: WO2011/092590

PCT Pub. Date: Aug. 4, 2011

(65) Prior Publication Data

US 2012/0040158 A1 Feb. 16, 2012

(30) Foreign Application Priority Data

Feb. 1, 2010 (FR) ..... 10 50696

(51) Int. Cl.

| | |
|---|---|
| ***B65H 75/18*** | (2006.01) |
| ***B65H 75/10*** | (2006.01) |
| ***A47K 10/16*** | (2006.01) |

(52) U.S. Cl.

CPC ..... *B65H 75/10* (2013.01); *A47K 10/16* (2013.01); *B65H 75/18* (2013.01); *B65H 2701/5112* (2013.01); *B65H 2701/532* (2013.01); *Y10T 428/24942* (2015.01)

(58) Field of Classification Search

USPC ..... 242/593, 610, 609.4, 610.1, 613, 613.5, 242/600

See application file for complete search history.

(56) References Cited

U.S. PATENT DOCUMENTS

| | | | | |
|---|---|---|---|---|
| 3,524,779 | A * | 8/1970 | Germiat et al. | 156/190 |
| 4,919,949 | A * | 4/1990 | Miltz et al. | 426/128 |

(Continued)

FOREIGN PATENT DOCUMENTS

| | | | |
|---|---|---|---|
| EP | 0967170 | A1 | 12/1999 |
| JP | 10316313 | A | 12/1998 |
| JP | 11029263 | A | 2/1999 |
| WO | 2009109723 | A1 | 9/2009 |

OTHER PUBLICATIONS

PCT International Search Report for International application No. PCT/IB2011/000164; International Filing Date: Feb. 1, 2011; Date of Mailing: Jul. 5, 2011; 2 pgs.

(Continued)

*Primary Examiner* — Emmanuel M Marcelo
*Assistant Examiner* — Justin Stefanon
(74) *Attorney, Agent, or Firm* — Drinker Biddle & Reath LLP

(57) ABSTRACT

A core has a cylindrical wall that can be torn axially and is made up of two superposed strips, these strips respectively being an outer strip in contact with the product and an inner strip, these strips being wound on one another and joined together by regions of attachment for example by bonding. At least one of the longitudinal edges of the inner strip is not attached or is weakly attached over a determined width in order, over at least part of its helical length, to form a free and accessible tab facing the outer strip.

17 Claims, 4 Drawing Sheets

(56) References Cited

U.S. PATENT DOCUMENTS

| | | | | |
|---|---|---|---|---|
| 5,251,809 | A * | 10/1993 | Drummond et al. | 229/202 |
| 5,671,897 | A * | 9/1997 | Ogg et al. | 242/610.1 |
| 5,865,396 | A * | 2/1999 | Ogg et al. | 242/610.1 |
| 6,036,139 | A * | 3/2000 | Ogg | 242/610.1 |
| 7,331,504 | B2 * | 2/2008 | Languillat et al. | 229/4.5 |
| 2011/0006145 | A1 * | 1/2011 | Denis et al. | 242/160.4 |

OTHER PUBLICATIONS

France Search Report for application No. 10 50696; Date of Filing Feb. 1, 2010; Date of Completion: Sep. 14, 2010; 2 pgs.

* cited by examiner

CORE FOR A PRODUCT IN SHEET FORM WOUND AROUND THIS CORE, AND ROLL FORMED WITH SUCH A CORE

The present invention relates to a core for a product in sheet form or the like wound around this core, and to the roll thus formed with such a core.

In the preferred although non-exclusive application of the invention, the product in sheet form on the roll is a wiping product, such as kitchen paper or toilet paper, and is made of absorbent paper, for example cellulose wadding. Of course, the wound product could be of some other nature.

At the present time, rolls of product in sheet form wound around a core (also known as central cylinder or tube) are used both for domestic and for professional purposes because of their practical, effective, economical and hygienic nature.

These rolls are generally placed on or in appropriate dispensers which may either feed from the side, where the first, precut or not precut, sheet of the wound product is pulled from the outside of the roll, or may be paid out from the centre, pulling the sheet in question axially from the inside of the roll.

In the case of centre feed, before or after a new roll (wound product and core) is installed in the dispenser, the core around which the sheet-form product is wound has to be removed in order to provide access, from the inside, to the first sheet of the product.

In fact, while the core is of use for winding the disposable sheet-form product, made of cellulose wadding, while the rolls are being manufactured, and for making these rolls more rigid for transport (safeguarding against crushing in particular), it is no longer, however, of any use when the product is being dispensed, and has to be removed. Hence, because this core is made of a relatively thick cardboard material to form a helically wound cylindrical wall, it cannot, in order to be extracted from the roll, be torn from the inside without the need to resort to special solutions.

One example of such special solutions is to provide perforations in the wall of the core, these running more or less parallel to the helix in which the strips or layers of bonded board that make up the core are wound. These perforations are generally situated on the inner strip, which is not in contact with the sheet of paper, parallel to the edges of the turns and in the region where the turns meet.

Another solution is a portion in strip form, made of kraft paper for example, bonded to a more rigid cardboard strip of the cylindrical wall of the core that allows the portion of kraft paper to be torn.

In the two solutions mentioned hereinabove, the breaking open of the cylindrical wall of the core is initiated by a shear force, which is applied in a radial direction towards the geometric axis of the core. This makes the extraction operation tricky and difficult in so far as access to the core, or grasping it in order to apply the extraction force to it, can be done only along the axis of the core. In addition, the relatively small diameter of this core does not make it any easier for the tear strips or portions to be grasped correctly.

Furthermore, in use, the pressure applied by the winding of the product on the wall of the core and the fact that the various strips and/or portions are completely bonded together over the entirety of their opposing surfaces very often makes grasping one of the strips or portions in order to apply the radial shear force difficult.

As a result, fitting these centre-feed rolls in the dispensers and readying them for use takes time, this time being spent removing the core and gaining access to the sheet-form product. In some cases, the user setting the new roll in place may abandon the extraction of the core when one of the strips tears in the width-wise direction within it, making the remaining part difficult to extract.

WO 2009/109723 owned by the applicant relates to a paper roll comprising a central hole with a reinforcement member on which the paper is wound. The reinforcement member includes one or two rings connected to the innermost turn of the roll that have a width smaller than the width of the roll and that are provided with a means, such as a tab for extracting the ring by applying a pulling force along the axis of the roll.

It is an object of the present invention to alleviate the disadvantages of the state of the art in relation to a core of a width at least approaching the width of the roll. The invention relates to a core for a product in sheet form wound around this core, that feeds out from the centre, that is produced in such a way that the cylindrical wall of the core can be completely torn and therefore fully extracted. The core is of substantially the same length as the roll of sheet-form product. It supports this product over its entire length or at least over half its length.

To this end, the core with tearable cylindrical wall around which a product in sheet form or the like, such as an absorbent paper, is wound to form a roll, the core of which has a length at least equal to half the length of the roll, and which has to be torn in order to access the product from the inside, is notable, according to the invention, in that the cylindrical wall can be torn axially, in that the cylindrical wall is made up of at least one strip, which strip is wound in a helix with an overlapping section, characterized in that said overlapping section comprises a first part and a second part, said first part forming a tab, said tab being weakly attached or not attached in order to be accessible form the inside of the core, the second part forming an attachment region of the strip and being released when submitted to an axially directed force of between 1000 cN and 2000 cN.

In particular the cylindrical wall is made up of at least two superposed strips, these respectively being an outer strip in contact with the product and an inner strip, which strips are wound in a helix on one another and attached to one another by a means of attachment such as is adhesive bonding, wherein said overlapping section is made of the section extending from the longitudinal edge of the inner strip to a longitudinal edge of the outer strip.

Thus, by virtue of the fact that the core is configured in the form of an overlapping section of one or two superposed strips with a free tab that is accessible from one of the transverse sides of the roll, the core can be extracted simply by applying an axial force to the unattached or weakly attached tab, parallel to the axis of the core, thus breaking the bonds between the two wound strips right along the wall and causing the torn core to collapse, whereupon it can be extracted. The core of the invention deviates of the rings described in WO 2009/109723 by the fact that the core is torn when the tab is pulled axially.

The expression "weakly attached" means that a light pull is enough to disengage and free the tab. This pull is weaker than the pull that has to be applied in order to break the said means of attachment between the two strips.

For example, in order to obtain the free tab, the two, outer and inner, strips of the wall that are wound on one another do not have the same width, thus forming the free and accessible tab of the inner strip.

According to various embodiments, the free tab formed by one longitudinal edge of the helically wound inner strip may:

either overlap the opposite other longitudinal edge of the inner strip; the width of the inner strip is larger than the width of the outer strip;

or be spaced away parallel to it, by a gap, from the opposite other longitudinal edge of the inner strip; the width of the inner strip is less than the width of the outer strip;

or be juxtaposed with it in the continuation of the opposite other longitudinal edge of the inner strip; the two widths are equal.

The first two embodiments may make it easier for the tab to be grasped by forming a helical projection (overlap) or space (spacing) on the interior surface.

According to another embodiment, both longitudinal edges of the inner strip form free tabs, regions with a means of attachment, for example by adhesive bonding, then being situated respectively one on each side of the join between turns of the outer strip against which the central part of the inner strip lies. In this case, the core can be torn from either one of its transverse sides.

The features of the invention are also valid for a core made of only one strip of cardboard or any other similar product.

The invention also relates to a roll of wiping product or toilet paper consisting of a core with a tearable cylindrical wall and of a product in sheet form around the core. Advantageously, this core has the features as defined hereinabove.

The figures of the attached drawing will make it easy to understand how the invention may be achieved. In these figures, identical references denote elements that are similar:

Figure 1:
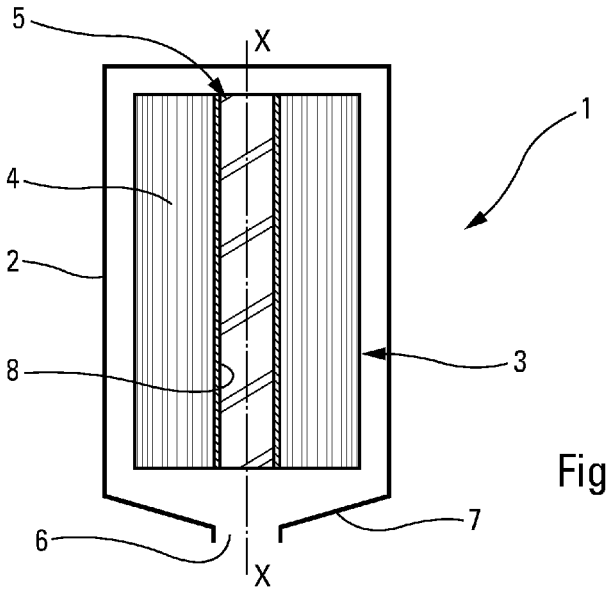
FIG. 1 is a schematic axial section of a centre feed dispenser of a product in sheet form wound around a tearable core according to the invention.

The centre feed dispenser 1 shown in FIG. 1 schematically comprises a vertical cylindrical body 2 inside which a roll 3 of wiping product, such as kitchen paper, which is made up of a wound product in sheet form 4 and of a core or tube 5 to support the product 4, is housed. An opening 6 is also made in the lower transverse base 7 of the body through which the unwound sheet-form product can freely pass; a cutting device, not depicted, may be provided at the opening 6 to make it easier to detach the pulled sheet-form product.

More specifically, this product is made of paper, such as cellulose wadding or the like, and is usually in the form of a longitudinal continuous sheet wound into a roll with or without transverse precut lines, while the core is made of cardboard.

Before or after the roll 3 is installed in the cylindrical body 2 of the dispenser, and before it is first used, the core 5 has to be removed in order to gain access to the first internal winding of the wound sheet-form product 4, from the inside. The length of the core is at least equal to half of the length of the roll. Also, the core 5 has a tearable cylindrical wall 8.

According to the embodiment shown in FIGS. 3 to 7, the wall is made up of at least two superposed strips (also known as portions), these respectively being an outer strip 10, facing towards the sheet-form product 4 to which it may or may not be secured by bonding along part of the first turn, and an inner strip 11, facing towards the axis X-X of the core. In particular, the two, outer and inner, strips 10, 11 are helically wound on one another at appropriate helix angles and pitches, at the time of manufacture, to form the cylindrical wall 8 of the core 5. The width of the outer strip is termed L1, its winding pitch P1, the width of the inner strip is termed L2 and its winding pitch P2. To create the core of the invention, the pitch P1 at which the outer strip is wound corresponds to a winding with contiguous turns. The pitch P2 of the inner strip is chosen to be equal to P1.

The strips 10, 11 are secured together along a first 12 and a second 12A region of attachment, for example by adhesive bonding, provided at set locations, as will be seen hereinbelow, along their respectively mutually-facing internal surfaces 14, 15.

Thus, it will be noted particularly from these figures that one of the two longitudinal edges 16, 17 of the wound inner strip 11, in this instance the longitudinal edge 16, has no means of attachment over a determined width right along the helical development between this free edge 16 of the inner strip 11 and that part 18 of the edge of the outer strip 10 that faces it. This longitudinal edge 16 thus forms a free and accessible tab 19, which faces the outer strip 10, so that said tab can be easily grasped from the lateral side 20 of the roll 3, that is to say of the core that is to be extracted, as shown by the arrow F in FIG. 2. This tab may potentially be weakly attached so that it can be freed by a gentle pull.

A first and a second region of attachment between the strips 10, 11 are provided excluding the free tab 19 and at least respectively one on each side of the join 21 between turns of the outer strip 10, so that this strip is carried along by the inner strip 11 when the free tab 19 is pulled axially in the direction of the arrow F in FIG. 2, as will be seen hereinafter with reference to FIGS. 3 to 7.

Along the first and second attachment regions 12, 12A, the two strips are preferably attached to one another by a film of adhesive. This adhesive may be a solid film spread over the mutually facing internal surfaces 14, 15 of the two strips and/or may be formed of continuous or discontinuous lines or patches.

Figure 2:
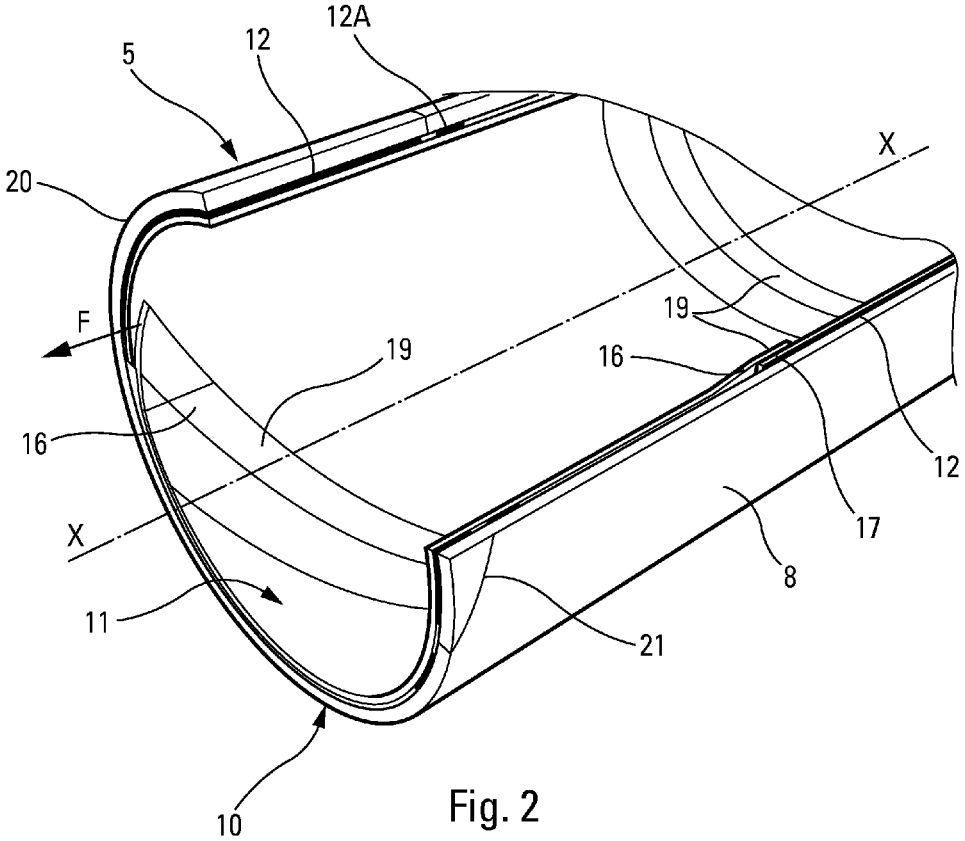
FIG. 2 is a partial perspective view of the core of FIG. 1.
Figure 3:
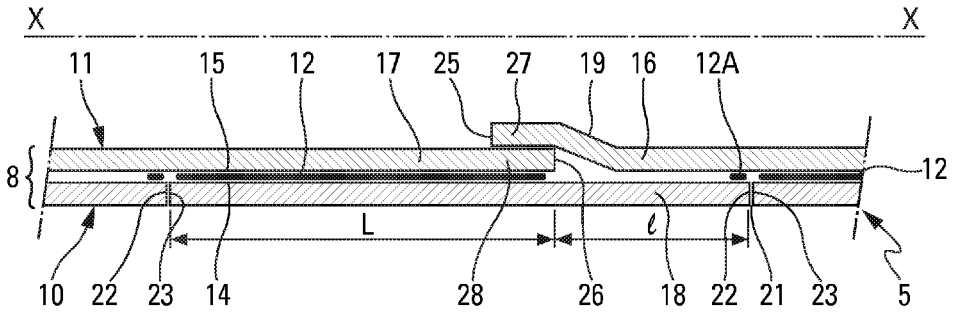
FIGS. 3 to 7 are axial part sections of various embodiments of the free tab of the core made of two strips, and that allow the latter to be torn and extracted.

In the embodiment illustrated in FIGS. 2 and 3, the core is formed by winding an outer strip 10 of width L1 and an inner strip 11 of width L2, the two widths being such that L2−L1=I. The outer strip is wound in a helix, preferably with contiguous turns. The inner strip is wound in a helix of the same pitch as the outer strip. Because L2>L1, the inner strip overhangs the adjacent turn. The overhang thus formed is of width I=L2−L1. It may thus be seen that the lateral sides or selvedges 25, 26 of the wound inner strip 11 are not contiguous like those of the outer strip 10 (FIG. 3) delimiting the join 21 of helical turn, but that the selvedge 25 of the free tab 19 (edge 16) overhangs the selvedge 26 of the opposite longitudinal edge 17 by a width I. Only an end part 27 of the width of the tab 19 covers a corresponding end part 28 of the opposite edge 17, so as to project outwards, that is to say radially towards the longitudinal axis X-X of the core 5. This visible end part 27 of the free tab 19, by the superposition of the winding turns that make up the inner strip 11, makes it easier to grasp, from the transverse end side 20 of the roll, so that an axial pull F parallel to the axis X-X can be applied to it as shown by FIG. 2.

FIG. 3 also shows a first region 12 of attachment between the two strips 10, 11 of the wall 8. Thus, for example, over one width (total width) of the outer strip 10 between its two selvedges 22, 23, only the part 18 facing the free tab 19 (substantially the width I shown on the figure) is unattached, whereas the remaining part "L" corresponds to the first region of attachment between the internal surfaces of the two strips. For preference, the first attachment region of width L extends over a distance greater than half the sheet width (in the depiction illustrated, for a total strip width, L is approximately equal to 21).

A second attachment region 12A takes the form of a helical line provided near the join 21 between turns of the outer strip, on the same side as the tab 19, and is thus defined as the "start" of the latter with respect to the remainder of the inner strip 11. The two attachment regions 12, 12A lie as close as possible to the join 21 between turns of the outer strip and this then allows the cores to be cut cleanly to the desired length without the risk of strip separation and, when the tab is pulled axially, allows tearing to progress cleanly along the join between turns.

The second attachment region 12A is smaller in size than the first attachment region 12 of width L.

More generally, irrespective of the size of the attachment region, the force required to rupture the bond between the strips in the first region 12 of width L is preferably greater than the force required to separate the strips from one another in the second region 12A. The part of the inner strip 11 extending from the lateral side or selvedge or longitudinal edge 25 to the longitudinal edge 22 of the outer strip 10 forms the claimed overlapping section.

For preference, when the attachment means consists of adhesive, the type of adhesive used in the second region 12A allows easy rupture under shear and may differ from that used in region 12. The characteristics of the first bonding region and of the second bonding region may differ either through the chemical nature of the adhesives or through the amount applied per unit area. According to an embodiment adhesive is applied on spots distant from each other. As an example, adhesive can be applied on circular spots of 3 mm diameter each and distant of 15 to 20 mm from each other.

Figure 3A:
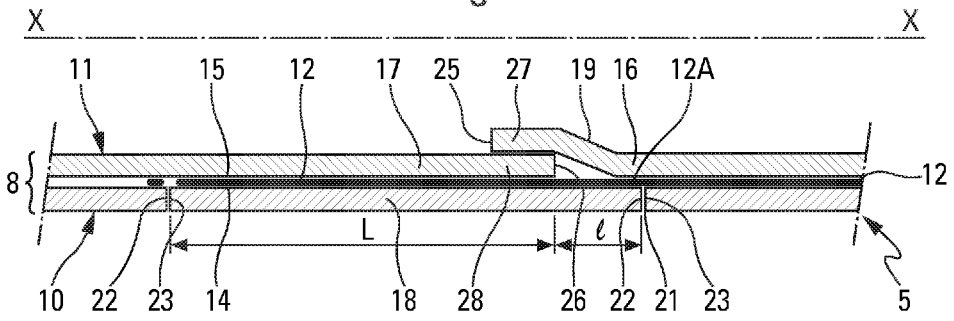

According to another embodiment shown in FIG. 3A, adhesive is applied to the entire surface of the outer strip but the overlapping section is very short. The second region 12A is thus narrow enough to allow easy rupture under shear between both strips. This embodiment has the advantage of making the application of adhesive more simple in the manufacturing process.

According to another embodiment of the overlapping section, adhesive is applied to the entire surface of one or the other of the two strips, and the part that forms the tab is treated in such a way that no bond is created, or alternatively that the bond that is created is weak. The treatment may consist of a surface treatment such that the adhesive does not stick, or alternatively the treatment may relate to the assembly of the fibres that make up one of the two strips such that the attachment obtained is a weak one.

According to another embodiment of the overlapping section, the attachment between the two strips (10, 11) is effected by heating hot-melt elements. The hot-melt elements may be an adhesive of the hotmelt type or alternatively may be hot-melt fibres or particles incorporated into one of the two strips or between the strips.

According to yet another embodiment of the overlapping section, the attachment between the strips is effected by mechanical fastening, for example by knurling.

Hence, when the axial force F is applied to the free tab 19, it leads unlike the earlier solutions which entailed radial rupturing, to axial rupturing of the attachment between the two strips that make up the wall of the core 5 and causes it to collapse as the pulling action is gradually applied to the tab, until the core can be extracted from the wound sheet-form product 4 and also until the first sheet of this product secured by bonding to the outer strip can be extracted via the centre of the roll 3. This then yields a tearable core structure with a free and visible tab achieved by the partial superposition of the wound turn of the inner strip of the wall and allows the core to be extracted from one single side (FIG. 2).

Figure 4:
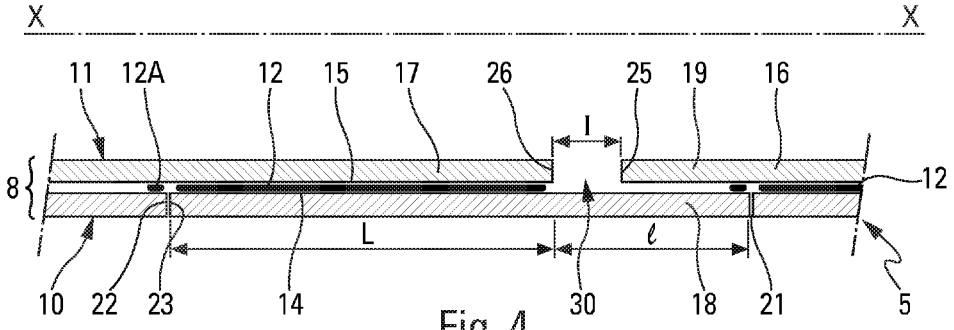

In the embodiment illustrated in FIG. 4, the width L1 of the outer strip is greater than the width L2 of the inner strip; we have the relationship L1−L2=I. The interior surface of the core has a helical space 30 between the selvedges 25, 26 of the edges 16, 17 of the wound inner strip 11, rather than the helical projection 27 of the previous embodiment, to make the tab easier to grasp. In particular, it may be seen that the gap I=L1−L2 is left between the selvedge 25 of the free tab 19 (corresponding to the edge 16 of the strip) and the selvedge 26 of the other longitudinal edge 17, thus forming the helical space 30.

The tab 19 depicted therefore has a width smaller than that of the previous embodiment but it could be the same. The first and second attachment regions 12 and 12A are identical to those of FIG. 3 with the same attached L and unattached 1 widths. This yields a tearable core structure with a tab and inner turn of the inner strip 10 of the wall 8, separated by the gap, with extraction from just one side of the core. The overlapping section in this embodiment extends from 25 to 22, and is formed of the tab 19 and the second region 12A.

Figure 5:
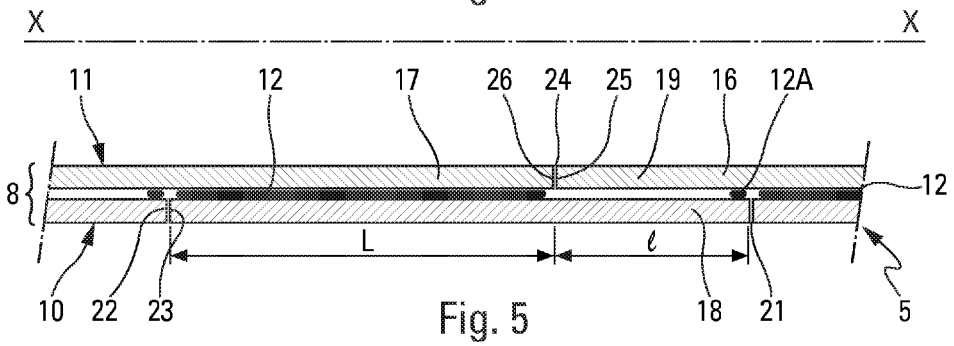

In the embodiment illustrated in FIG. 5, the width L1 of the outer strip is equal to the width L2 of the inner strip and we have the relationship L1−L2=0. The selvedges 25, 26 of the longitudinal edges (one corresponding to the tab) of the inner strip 11 face one another in order thus to form a join 24 between turns, like in the case of the outer strip 10. The widths L and 1 of the attached and unattached (tab 19-part 18) regions of the strips are identical to those of FIG. 3. This then yields a tearable core structure in which the inner turn and tab are contiguous, with no gap and no overlap.

Figure 5A:
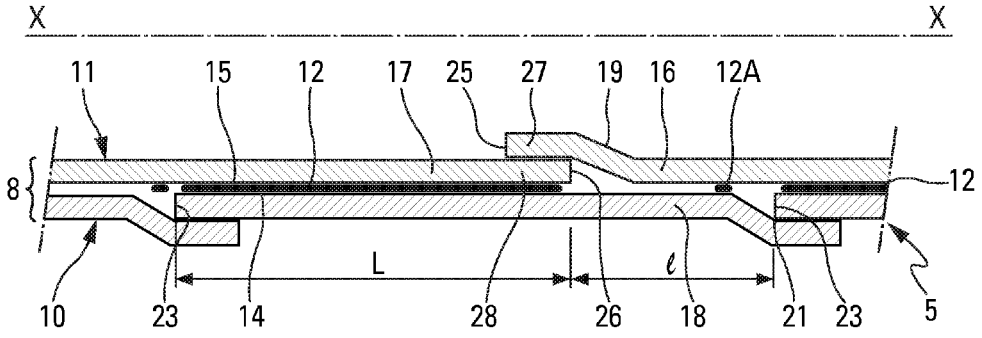

An alternative to the embodiment of FIG. 5 is presented in FIG. 5A. In this embodiment the widths L1 and L2 are equal but the pitch of the helical enrolment formed by the strips is lower than their width. An overlap between the windings results from this arrangement.

More generally according to the relationship between both widths L1 and L2 there results an overlap between the windings of the strip 11 or not.

Figure 6:
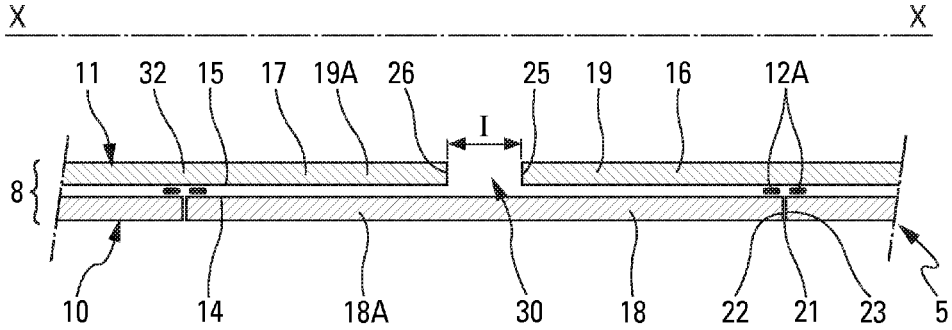
Figure 7:
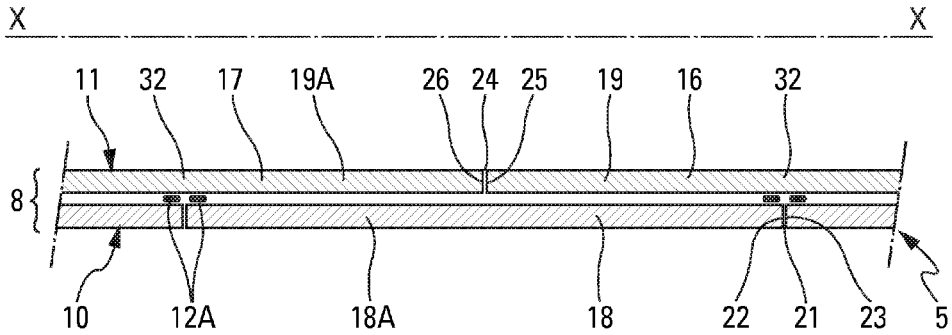

The embodiments illustrated in FIGS. 6 and 7 are alternative forms of the embodiments of FIGS. 4 and 5, the longitudinal edges 16, 17 of the helically wound inner strip 11 act as free tabs 19 and 19A such that the core 5 can be torn and extracted from either one of its lateral sides 20.

For that, the first and second attached regions are restricted only to helical lines or patches 12A on each side of the join 21 between turns of the outer strip 10 respectively. Thus, the inner strip 11 is simply attached at its middle (in its middle region 32) along helical patches 12A, leaving these longitudinal edges 16, 17 free, the width of each corresponding, in these embodiments, to almost half the sheet width.

The difference in embodiment between the two modes of FIGS. 6 and 7 lies, in the case of FIG. 6, in the fact that there is a gap I, forming the helical space 30, between the selvedges 25, 26 of the free tabs 19, 19A to make one of these easier to grasp and, in the case of FIG. 7, in the absence of a gap, the selvedges 25, 26 of the free tabs 19, 19A delimiting the join 24 between turns.

This then, in these embodiments, yields a tearable core structure with two tabs that are either spaced apart or contiguous and with smaller partial attached regions, and allows the core to be extracted from either of the two transverse sides.

The two strips 10, 11 that make up the tearable cylindrical wall 8 of the core 5 may have the same or different geometric characteristics—sheet width, thickness—and may similarly have either the same or different physical characteristics—material, basis weight, softness and strength.

Figure 8:
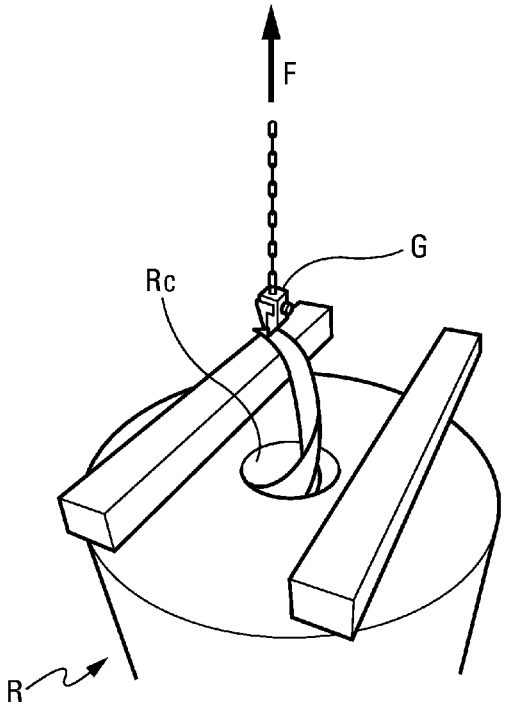
FIG. 8 represents the mounting on a dynamometer for determining the force required on the tab for releasing the bond on the attachment region.

The tearing strength required by the user to tear off the core is determined with a unit as shown in FIG. 8. The roll R with the core Rc to be tested is placed vertically on the lower platform of a dynamometer (not shown) and attached to it. The tab is attached to the grip G of the dynamometer. The dynamometer is actuated and the grip G with the tab is pulled vertically up at a constant speed. The force F on the grip is measured during the movement of the tab, and the maximum force as measured is considered as the tearing force.

The device used is a dynamometer with a nominal traction force of 500 N and a means for recording the force on the tab during the test. The speed of the grip G in the vertical direction is 200 mm/min. The core is Rc was made of an outer cardboard strip and an inner cardboard strip. The outer cardboard strip had a width of 70 mm and grammage of 180 g/m$^2$. The inner cardboard strip had a width of 80 mm and a grammage of 230 g/m$^2$.

Figure 9:
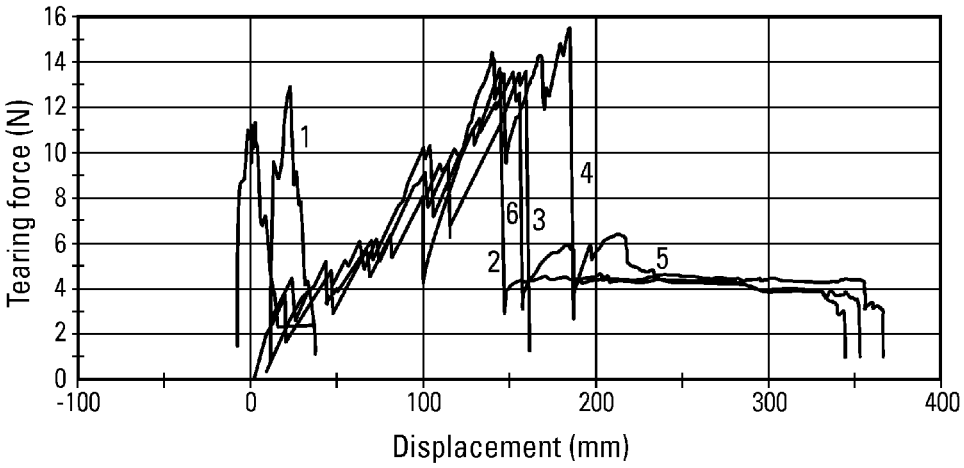
FIG. 9 is a graph showing the relation between the stroke of the tab when a pulling tearing force is applied to it and the pulling tearing force.

FIG. 9 shows one example for the relationship between the pulling force applied to the tab (axis of ordinates) and the displacement of the tab (axis of abscissa); six tests 1 to 6 are plotted on the graph of said figure. In this specific example it can be seen that the tearing force, when using the core of the invention, has a value well below 30 N.

However, it shall be understood that the value according to the invention can be of up to 30 N, representing the value a person would apply on the tab and tear the core without difficulty. Furthermore it shall be noted that the bond in the attachment region should be higher than a minimum corresponding to releasing the core under the internal tensions within it.

Thus the value should be between 1000 and 3000 cN, preferably between 1000 and 2000 cN, and most preferably between 1000 and 1300 cN.

The invention claimed is:

1. A tearable core, comprising:

a tearable cylindrical wall around which a product in sheet form may be wound to form a roll having a length in a longitudinal direction of the cylindrical wall, the tearable core having a length at least equal to half the length of the roll, and having to be torn in order to access the sheet-form product from inside the roll;

wherein the cylindrical wall is made up of at least two superposed strips including an outer strip disposed to be in contact with the product and an inner strip, the strips being wound in a helix on one another and attached to one another with an overlapping section, said overlapping section made of a section extending from a longitudinal edge of the inner strip to a longitudinal edge of the outer strip;

wherein said overlapping section comprises a first part and a second part, said first part forming a tab, said tab being free of adhesive over a defined width from said longitudinal edge of the inner strip in order to be free and accessible from the inside of the tearable core, the second part forming an attachment region of the strip and being disengageable when submitted to an axially directed force of between 1000 cN and 3000 cN; and wherein a first attachment region and a second attachment region are created between the two strips at least on each side of a join between turns, at least one of said attachment regions being released when submitted to said axially directed force of less than 3000 cN.

2. The tearable core according to claim 1, wherein an attachment in the overlapping section is effected by adhesive bonding.

3. The tearable core according to claim 1, wherein attachment in the attachment region is effected by heating hotmelt elements.

4. The tearable core according to claim 1, wherein attachment in the attachment region is effected by mechanical fastening.

5. A roll of absorbent paper comprising a tearable core with a tearable cylindrical wall and a product made of absorbent paper wound around the tearable core, wherein the tearable core is in accordance with claim 1.

6. A tearable core, comprising:

a tearable cylindrical wall around which a product in sheet form may be wound to form a roll having a length in a longitudinal direction of the cylindrical wall, the tearable core having a length at least equal to half the length of the roll, and having to be torn in order to access the sheet-form product from inside the roll;

wherein the cylindrical wall is made up of at least two superposed strips including an outer strip disposed to be in contact with the product and an inner strip, the strips being wound in a helix on one another and attached to one another with an overlapping section, said overlapping section made of a section extending from a longitudinal edge of the inner strip to a longitudinal edge of the outer strip;

wherein said overlapping section comprises a first part and a second part, said first part forming a tab, said tab being not attached over a defined width from said longitudinal edge of the inner strip in order to be free and accessible from the inside of the tearable core, the second part forming an attachment region of the strip and being disengageable when submitted to an axially directed force of between 1000 cN and 3000 cN;

wherein a first attachment region and a second attachment region are created between the two strips at least on each side of a join between turns, at least one of said attachment regions being released when submitted to said axially directed force of less than 3000 cN; and wherein a width (L2) of the inner strip and a width (L1) of the outer strip are defined, with windings of the inner and outer strips being wound at a same pitch, so that the free and accessible tab of the inner strip is formed adjacent to the join between turns of two facing longitudinal edges of the helically wound outer strip.

7. The tearable core according to claim 6, wherein (L2>L1), the free tab being formed by one longitudinal edge of the helically wound inner strip overlapping an opposite longitudinal edge of the inner strip.

8. The tearable core according to claim 6, wherein (L2<L1), the free tab being formed by one longitudinal edge of the helically wound inner strip being spaced away from and parallel to an opposite longitudinal edge of the inner strip by a gap.

9. The tearable core according to claim 8, wherein both longitudinal edges of the inner strip form free tabs, the attachment regions being situated respectively one on each side of the join between turns of the outer strip against which a central part of the inner strip lies.

10. The tearable core according to claim 6, wherein (L1=L2), the free tab being formed by one longitudinal edge of the helically wound inner strip lying juxtaposed with and in the continuation of an opposite longitudinal edge of the inner strip.

11. The tearable core according to claim 6, wherein the first and second attachment regions of the strips extend over a width of the superposed inner and outer strips excluding the free tab.

12. The tearable core according to claim 11, wherein the first and second attachment regions have different bonding characteristics.

13. The tearable core according to claim 6, wherein a width of the first and second attachment regions in which the wound superposed inner and outer strips are bonded together exceeds a width of the free tab.

14. The tearable core according to claim 6, wherein an attachment in the overlapping section is effected by adhesive bonding.

15. The tearable core according to claim 6, wherein attachment in the attachment region is effected by heating hotmelt elements.

16. The tearable core according to claim 6, wherein attachment in the attachment region is effected by mechanical fastening.

17. A roll of absorbent paper comprising a tearable core with a tearable cylindrical wall and a product made of absorbent paper wound around the tearable core, wherein the tearable core is in accordance with claim 6.

* * * * *